United States Patent [19]

Suh

[11] 4,278,622

[45] Jul. 14, 1981

[54] METHOD FOR FORMING METAL, CERAMIC OR POLYMER COMPOSITIONS

[75] Inventor: Nam P. Suh, Sudbury, Mass.

[73] Assignee: Massachusetts Institute of Technology, Cambridge, Mass.

[21] Appl. No.: 124,694

[22] Filed: Feb. 26, 1980

Related U.S. Application Data

[63] Continuation-in-part of Ser. No. 78,320, Sep. 24, 1979, abandoned.

[51] Int. Cl.[3] ..... B01J 2/06

[52] U.S. Cl. ..... 264/11; 264/299

[58] Field of Search ..... 264/11, 299

[56] References Cited

U.S. PATENT DOCUMENTS

| | | | |
|---|---|---|---|
| 3,970,445 | 7/1976 | Gale et al. | 264/11 |
| 4,124,377 | 11/1978 | Larson | 70/0.5 C |

*Primary Examiner*—Donald E. Czaja
*Assistant Examiner*—James R. Hall
*Attorney, Agent, or Firm*—Arthur A. Smith, Jr.; Paul J. Cook

[57] ABSTRACT

Fine grain metal, ceramic or metal-ceramic or metal-polymer compositions are formed by impinging at least two liquid streams of metal, ceramic and/or polymer, upon each other to form a turbulent mixture having small eddies. At least a portion of the mixture is frozen quickly before grain and/or cell growth in the mixed components occurs to any substantial extent. The resultant product can be a solid or a slurry.

19 Claims, 12 Drawing Figures

HIGHER PARTS (WHITE): TIN & LEAD x 20,000
LOWER PARTS (BLACK): LEAD

METHOD FOR FORMING METAL, CERAMIC OR POLYMER COMPOSITIONS

REFERENCE TO RELATED APPLICATION

This application is a continuation-in-part of Ser. No. 078,320, filed Sept. 24, 1979 now abandoned.

BACKGROUND OF THE INVENTION

This invention relates to a method for forming fine grain structure compositions for metals and/or ceramics and to the compositions produced.

It is well known that the mechanical properties of solids are controlled by their microstructures. For this reason, metals are often wrought from ingots and machined, rather than being cast into final shapes. Hot and cold working breaks down the carbides in steel and elongates grains which, upon annealing, yield smaller microstructures with small grains and second phase particles. By these means, toughness and strength are imparted to metal parts. However, there are limits to the grain size that can be attained by these techniques. To obtain grains on the order of micron or less, metals and ceramics are produced in fine powders first and then are compacted and sintered to make the final parts. Again, there are limitations in producing parts by powder metallurgy techniques due to the grain growth during sintering and due to oxidation of the powder. The need to work and cut metals and the necessity to produce powder add to the overall manufacturing costs. For example, in the manufacturing of an aircraft spar, a worked and heat treated aluminum ingot is machined on a 3 to 7 million dollar spar mill over many hours to remove more than 70% of the original aluminum. The manufacturing cost can be reduced substantially if it can be cast to near net shape. There are also many machine parts forged and then machined such as landing gears and cranks, all adding to the cost. Presently, the most expensive process may be a powder metallurgy technique for most parts. Powder metallurgy products cost as much as ten times cast products, although powder metallurgy parts have better mechanical properties and processability than cast products.

The major shortcoming of the casting technology is the lack of the grain size control. Present casting methods can not yield micron sized grains. Although such a fine-grained structure may not be necessary in some applications, there are many other applications where such a uniformly distributed grain structure can substantially enhance the mechanical properties and thus expand the applicability of various materials. Trial products produced from such materials can be shaped more easily and can be made stronger and tougher as compared to products made by present casting techniques. Conventional manufacturing process can only yield these desirable properties at high costs and they are limited by equilibrium thermodynamic considerations.

Most of the modern metal processing techniques depend on equilibrium thermodynamics, except perhaps the recently developed splat cooled powder metallurgy techniques. However, if one can process immiscible materials and yield uniformly distributed phases with a well controlled microstructure, many interesting desirable properties can be imparted to the part. For example, magnetic materials can be dispersed in a non-magnetic matrix and vice-versa. Bearing materials can be made in which the molecules or elements that reduce the coefficients of friction can be incorporated in a matrix. Even such hard particles as oxides, nitrides, borides and carbides can be dispersed in a metal matrix. What is needed is a method of creating solids with various materials combinations and certain desired microstructures.

SUMMARY OF THE INVENTION

The present invention provides for metal and/or ceramic or metal-polymer compositions having a fine grain structure not attainable by present casting techniques. These compositions are obtained by causing two or more liquid metal, polymer and/or ceramic streams to impinge upon each other under pressure so as to create a mixture under turbulent flow having small eddies. The resultant mixture then is frozen substantially immediately after impingement in order to freeze the mixture while in this turbulent flow state and before the components of the mixture can separate. That is, it is desireable to effect cooling so that the viscous forces of the overall mixture overcome the surface tension forces thereby minimizing or preventing coalescence of the components. Thus, grain growth by surface tension force mechanisms and by diffusion is minimized by quickly cooling the mixture after formation of the eddies during mixing of the components to cause turbulent flow. In one aspect of the invention, a slurry can be formed rather than a solid. This can be effected when the impinging streams have different melting points so that one component freezes quickly after mixing and when the melting points are the same, slurry can be formed through immediate cooling to solidify only a portion of the resultant mixture and mixing of the cooling material using static mixers, etc.

DESCRIPTION OF SPECIFIC EMBODIMENTS

Figure 1:
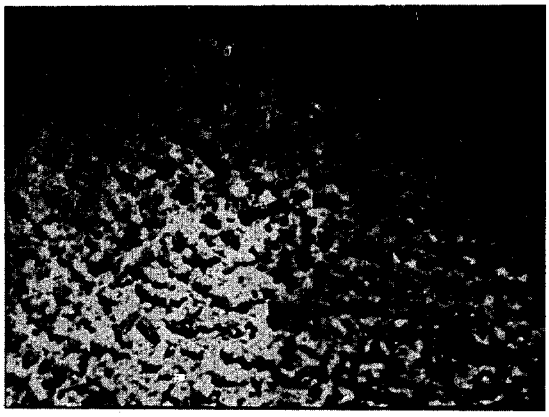
FIG. 1 is a photomicrograph of a lead-tin alloy mixed at 40 psi.
Figure 2:
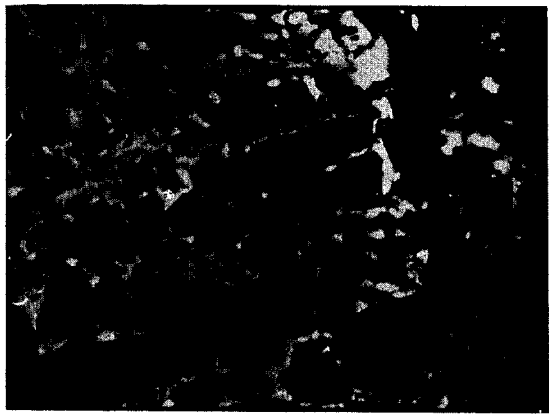
FIG. 2 is a photomicrograph os a lead-tin alloy mixed at 20 psi.
Figure 4:
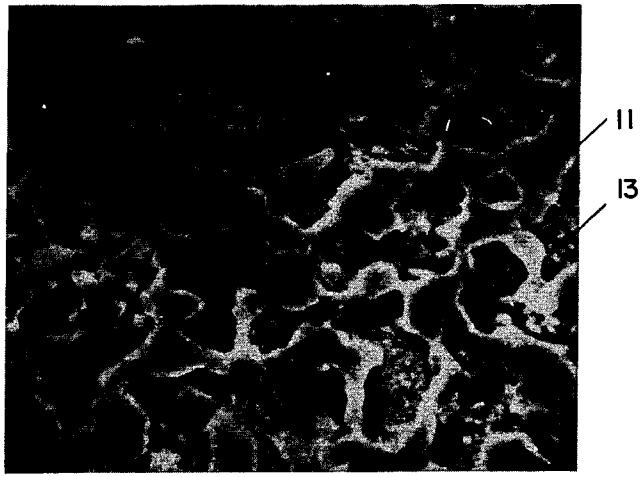
FIG. 4 is a picture taken with a scanning electron microscope of a lead-tin alloy mixed at 40 psi.

The present invention provides a metal, ceramic or metal-ceramic or metal-polymer composition having a fine grain structure and which is formed directly from two or more liquid compositions which are intimately admixed to effect turbulent flow of the resultant mixture. Small grain size structures result due to the eddies formed during the turbulent flow when it is cooled quickly to freeze the overall composition. The formation of smaller grains can be further insured by permitting the temperature of individual streams to be so different that, upon the formation of intermixed eddies, the heat transfer between the eddies result in rapid nucleation of the solid phase formed from the liquid component that has the higher freezing temperature. It is necessary to freeze the composition quickly after mixing is ended in order to prevent formation of large grains within the resultant composition by surface tension forces and/or by diffusion. By the phrase "small grain size" as used herein is meant grains smaller than 30 microns down to sub-micron size. In the case of metal compositions, the compositions of this invention comprise one or more phases, the number of which is governed by the Gibbs Phase Rule. Each liquid stream entering the mixing chamber may either form a contiguous phase in relation to other phases present as shown in FIG. 4 or a discontinuous phase and a matrix phase as shown in FIGS. 1 and 2. It should be noted that the liquid streams may be of the same chemical composition or different chemical compositions. Each liquid stream can be formed of a pure element, of a solid solution or slurry consisting of liquid and solid particles. The solid particles can be hard phases such as carbides, nitrides, borides or oxides in the form of equiaxial particles or fibers. In the case of foamed metals, the solid phase can be a foaming agent which will decompose in the mixing chamber or be removed by other means to create a cellular structure. The liquids in each stream can either have the same or different viscosities as long as the velocity of each stream is such that the Reynolds Number associated with each stream exceeds a critical value which is about 50.

The microstructure of the compositions of this invention is unique in that the grain size is much smaller than the grain size of compositions formed by normal casting procedure. This is due to the rapid solidification in accordance with this invention which permits little or no grain growth. In addition, the metal compositions of this invention differ from those made by presently available metal powder metallurgical techniques in that the metal compositions of this invention are substantially free of oxides. In contrast, the microstructure of articles formed by metal powder matallurgy techniques contain substantial concentrations of oxides. In addition, the compositions of this invention may include at least one thermodynamic non-equilibrium phase. The microstructure of the compositions of this invention comprise irregular globules that differ in physical structure from normal dendrite microstructures in that there is little or no interconnecting branches among the globules. Furthermore, the grains have substantially different orientation from one another in that there is little or no adjoining grain having substantially the same orientation. The microstructure of the product can be controlled by controlling the temperature of each impinging stream thereby to regulate the freezing rate at which the highest melting point component of the mixture solidifies. When one component freezes immediately upon impingement, the fine grain size microstructure disclosed above is obtained. When the temperature of the impinging streams are such that freezing occurs more slowly such that a degree of coalescence of the eddies occurs prior to freezing, an interpenetrating continuous network structure of the component phase can be attained, especially when the two metals are immiscible.

In one aspect of this invention, a slurry product is formed rather than a solid product even when the streams have the same freezing points. In this embodiment, the liquid streams impinging upon one another have the same composition and the cooling after mixing is controlled so as to solidify only a portion of the resultant mixture while the eddies still exist in the mixture. The slurry is subjected to mechanical mixing while controlling temperature so as to maintain the mixture in slurry form. The slurry then can be cast such as in a mold, by continuous casting or the like. By operating in this manner, the casting apparatus is required to extract less heat as compared to processes which form liquid metals which results in increased mold life.

The compositions of this invention are formed by impinging at least two liquid streams upon each other so that turbulence is created. This is attained most preferably by moving the streams toward each other from opposite directions. The size of the eddies created during turbulence is proportional to the Reynolds Number based on the diameter of the nozzle of the liquid stream resulting from the admixture of the individual streams in accordance with the relationship:

$$l \sim (Re)^{-\eta}$$

wherein l is the size of the average eddy, Re is the Reynolds number and $\eta$ is the factor generally within the range of about $\frac{1}{2}$ to about $\frac{3}{4}$. In accordance with the relationship given above, as the Reynolds Number increases, the eddy size decreases. Accordingly, when smaller grain size, i.e., eddy size in the resultant mixture is desired, the Reynolds Number of each individual stream should be increased accordingly so that the two or more streams impinge upon each other with substantial force thereby effecting an increased turbulence in the resultant mixture. It should be noted that each eddy may contain more than one grain. Since the turbulence attained in the resultant liquid of the streams will be dissipated in time, it is desirable to effect freezing of the resultant liquid mixture as quickly as possible. Quick freezing is effected in order to maintain the small eddy size caused by the initial stream impingement, thereby to minimize separation of the mixed liquids into their initial component parts caused by coalescence through surface tension forces of the component parts. Accordingly, the turbulent mixture is cooled immediately after mixing. Cooling can be effected in a wide variety of methods including continuous casting, cooling on a moving sheet, (i.e., belt), cooling in individual molds, etc. Cooling to obtain a solid product is initiated only after all of the liquid components have been impinged upon each other to effect the desired turbulence. Mixing of individual liquid components can be effected simultaneously or sequentially. For example, two or more liquids can be made to impinge upon each other in an initial step followed as closely thereafter as possible by impingement with an additional liquid stream on the turbulent liquid stream resulting from the first mixing step. Furthermore, the mixture resulting from initial impingement of two or more streams can be separated into two or more component portions to form liquid streams which are caused to impinge upon each other thereby to effect increased turbulence and admixture. By operating in this manner, it is possible to obtain products having a microstructure with very small grain size. After the final liquid stream has been impinged upon the main turbulent stream, resultant turbulence then is cooled as quickly as possible after the final mixing.

In one aspect of the present invention, grain size of the resultant product also can be controlled by the respective temperatures of the individual liquid streams being impinged upon one another so that, upon mutual impingement, one of the streams is caused to solidify by virtue of being cooled by one or more of the other impinging liquid streams. This aspect of the invention is particularly important wherein it is desirable to homogeneously admix small particles of a ceramic composition within a metal matrix. Since ceramic compositions generally have a much higher melting point than metal compositions, the ceramic compositions can be easily cooled into a temperature range wherein they solidify while the metal composition remains in the liquid state. In this embodiment, the temperature differential between the liquid and the ceramic liquid stream should not be so large that the ceramic liquid solidifies prior to being homogeneously dispersed into small particles, i.e., the ceramic solidifies in the form of large globules.

The compositions of this invention can be formed from any metal alloy or pure metal regardless of its chemical composition or from any ceramic composition or polymer so long as the composition can be changed to the liquid state upon heating thereof. Partially polymerized liquid or monomers of polymeric substance can also be used. Representative suitable alloys include lead alloys, magnesium alloys, zinc alloys, aluminum alloys, copper alloys, iron alloys, nickel alloys or cobalt alloys. Examples of these alloys are lead-tin alloys, zinc-aluminum alloys, zinc-copper alloys, magnesium-aluminum alloys, magnesium-aluminum-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super alloys and cobalt-chromium alloys or pure metals such as iron, copper, zinc, aluminum, nickel or magnesium or the like. Representative suitable ceramic compositions include nitrdies, carbides, silicides, borides, oxides, carbonitrides or oxycarbides. Polymers which are not thermally degraded by being admixed with low melting metals also can be utilized in this invention. Suitable polymers include polyethylene, epoxy, polyester polypropylene, polystyrene or the like. At least one of the impinging streams is a metal, ceramic, metal alloy or mixtures thereof so that not more than one stream is a polymer.

In another aspect of this invention, the liquids to be admixed can contain small solid particles suspended therein prior to admixture which can comprise any solid particles which are normally added to a metal or ceramic composition to change one or more physical characteristic(s) of the metal or ceramic composition. In this embodiment of the invention, the liquid matrix containing the solid particles is vigorously agitated in a container so that the solid particles are suspended substantially homogeneously within the liquid matrix and the liquid containing the particles then is directed to a zone for admixture with a second liquid stream in the manner described above. Representative suitable examples of solid particles include graphite, sand, glass, ceramics such as metal oxides and metal carbides, pure metals, metal alloys, etc. Generally, the particles should have a size less than about 15 microns, preferably between about 15 microns and about 0.01 microns. The concentration of particles within the liquid phase should be such that the particles are homogeneously distributed in the final product after freezing and do not separate from the liquid prior to freezing either by flotation or settling. The particular concentration of particles within a particular liquid phase composition depends primarily upon the wetting characteristics of the particles within the liquid phase; the greater the wetability on the surface of the particles, the higher the concentration of particles that can be retained homogeneously within the liquid phase. As described above, the liquid composition containing the particles therein is frozen immediately after the liquid streams have been impinged upon each other to cause the desired turbulence and eddy formation. In addition, the concentration of particles capable of being retained homogeneously in the liquid phase is governed by the viscosity of the liquid phase.

Figure 3:
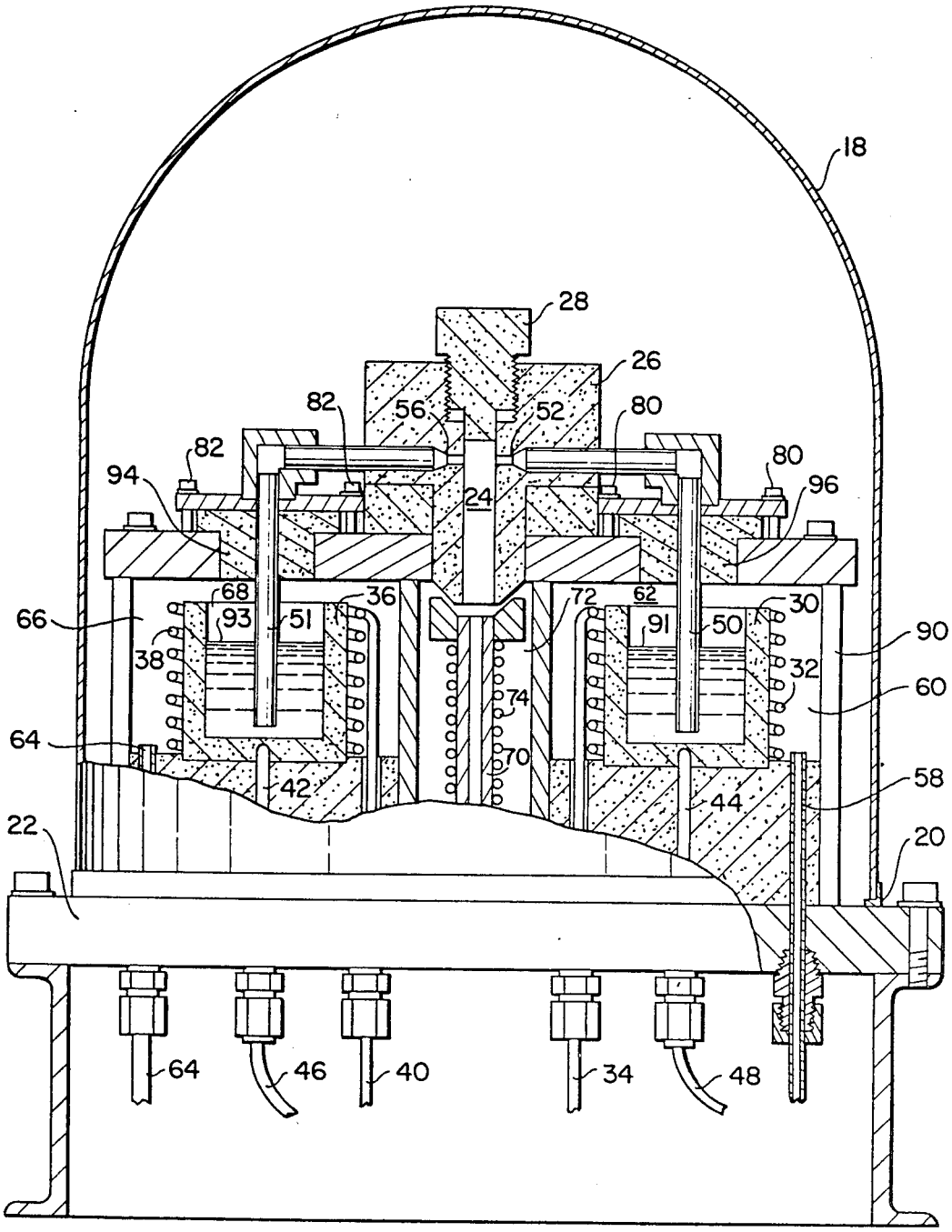
FIG. 3 is a cross-sectional view of an apparatus suitable to form the compositions of this invention.

FIG. 1 is a photomicrograph of a tin-lead alloy formed in the apparatus of FIG. 3 wherein a stream of liquid lead was impinged upon a stream of liquid tin each at 40 psi. The resultant metal product comprises a non-continuous phase 10 of lead having an average grain size of about 1.5 microns and a continuous phase of tin.

FIG. 2 is a photomicrograph of a tin-lead alloy formed in the apparatus of FIG. 3 by the impingement of a liquid lead stream upon a liquid tin stream each at a pressure of 20 psi. The resultant metal composition comprises a non-continuous phase of lead 14 having an average grain size of about 15 microns and a continuous phase 16 of tin.

Referring to FIG. 3, the apparatus for forming the compositions shown in FIGS. 1 and 2 comprises a bell jar 18 which is sealed at the bottom by flange 20 positioned on base 22. A mixing chamber 24 is formed within graphite number 26 and comprises a hollow, generally cylindrical shape the length of which can be changed by movable adjustment member 28 also formed of graphite. As shown in FIG. 3, the apparatus is suitable for mixing two liquid components which can be subsequently frozen. A first liquid component is housed within graphite container 30 which is surrounded by heating coil 32 connected to a power supply 34. The second liquid component is housed within graphite container 36 surrounded by heating coil 38 which is connected to a power supply 40. Thermocouples 42 and 44 are connected respectively to power supplies 46 and 48 and partially embedded into the wall of containers 36 and 30 respectfully to monitor the temperature within the containers. An L-shaped conduit 50 extends into container 30 and is connected to nozzle 52. L-shaped conduit 54 extends into container 36 and is connected to nozzle 56. The nozzles 52 and 56 communicate with chamber 24. Conduit 58 is connected to a gas supply (not shown) and extends into chamber 60 which includes a space 62 above container 30. Conduit 64 also is connected to a pressurized gas supply (not shown) and extends into chamber 66 having a section 68 positioned above container 36. A mold 70 is positioned within chamber 72 below chamber 24 and is surrounded by a cooling coil 74 which is connected to a refrigeration means (not shown).

The apparatus of FIG. 3 is utilized as follows: the bell jar 18 is removed and the bolts 80 and 82 are loosened in order to remove L-shaped conduits 50 and 54 as well as graphite holder 26 from the apparatus to expose containers 30 and 36. A first metal composition is placed in container 30 and a second metal composition is placed in container 36. The L-shaped conduits 50 and 54 are then replaced and the bolts 80 and 82 tightened in order to seal the chambers 60 and 66 from the atmosphere by means of wall 90 and plugs 96 and 94. Power then is provided to coils 32 and 38 in order to melt the metal compositions within chambers 30 and 32. The temperatures within chambers 30 and 36 are monitored by means of thermocouples 42 and 44 and, after the metals within the chambers are melted, gas is supplied to the chambers 60 and 66 through conduits 58 and 64 respectively in order to increase the pressure therein and specifically to increase the pressure in spaces 62 and 68 above the surfaces 91 and 93 of the liquid metal. It is desirable to effect this pressure rise as quickly as possible so that liquid flow through the L-shaped conduits 50 and 54 is effected at high pressure. The liquid emanating from nozzles 52 and 56 impinge upon each other at high pressure within chamber 24 causing the desired mixing and resulting in a high Reynolds Number for the liquid mixture within chamber 24. The liquid mixture within chamber 24 falls by gravity into mold 70 and is cooled sufficiently quickly so that the eddies resulting from the desired turbulence of mixing are frozen within the solid product within the mold 70.

Figure 5:
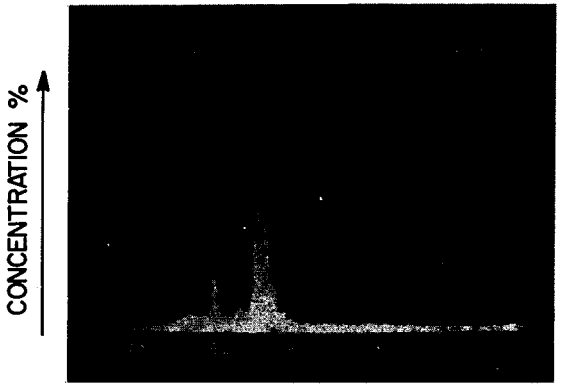
FIG. 5 shows the relative concentrations of tin and lead in area 11 of FIG. 4.
Figure 6:
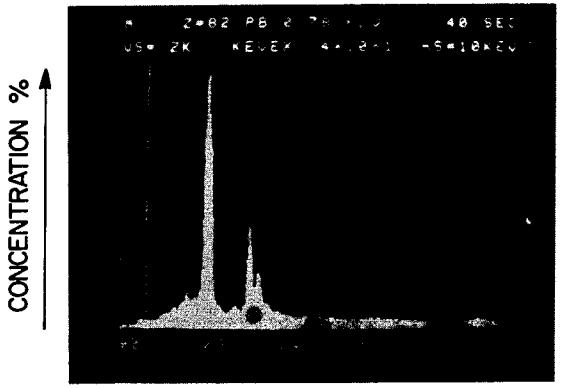
FIG. 6 shows the relative concentrations of tin and lead in area 13 of FIG. 4.

FIG. 4 is a picture produced by a scanning electron microscope at 4,750 times magnification of a tin-lead alloy formed by the process of this invention wherein the area 11 has the composition shown in FIG. 5 and the area 13 has the composition shown in FIG. 6. The relative height of the tin and lead peaks correspond to the ratio of tin to lead at the point measured. The graphs of FIGS. 5 and 6 were obtained with a scanning electron microscope.

Figure 7:
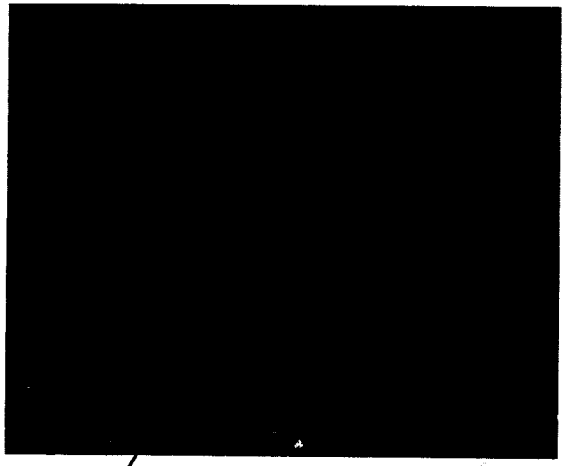
FIG. 7 is a picture taken with a scanning electron microscope 20,000 times magnification of the composition of FIG. 4.
Figure 8:
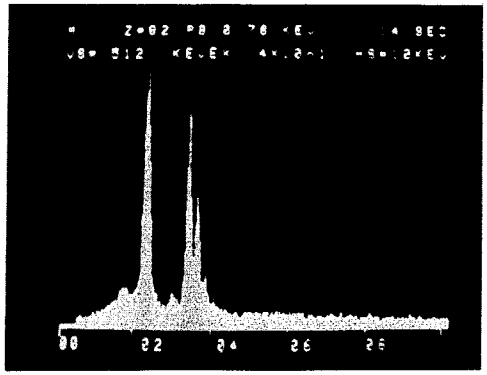
FIG. 8 shows the relative concentrations of tin and lead in area 15 of FIG. 7.

FIG. 7 is a picture produced by a scanning electron microscope at 20,000 times magnification where the area 15 has the composition shown in FIG. 8. The relative height of the tin and lead peaks correspond to the ratio of tin to lead at the point measured. The graph of FIG. 8 was obtained with a scanning electron microscope.

Figure 9:
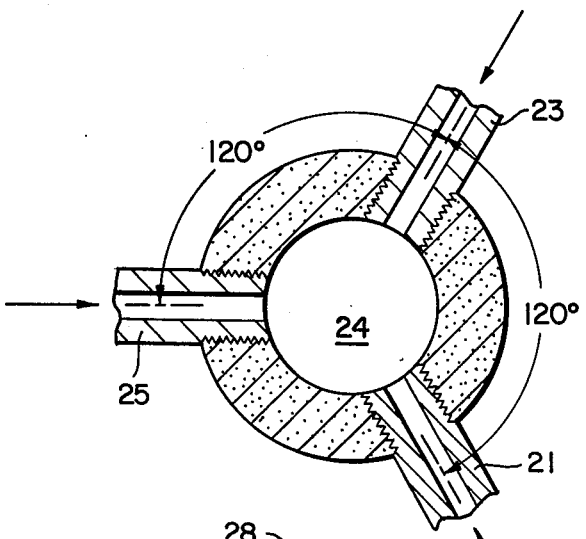
FIG. 9 is a horizontal cross-sectional view of an apparatus for impingement of three liquid streams.

Referring to FIG. 9, a mixing chamber suitable for effecting multiple impingement of liquid streams is shown and comprises a modification of the apparatus shown in FIG. 3. The mixing chamber shown in FIG. 9 shows three equally spaced impingement nozzles 21, 23 and 25 placed on the same horizontal plane in the mix chamber 24. The liquid components are supplied from three reservoirs in a manner similar to that shown in FIG. 3.

Figure 10:
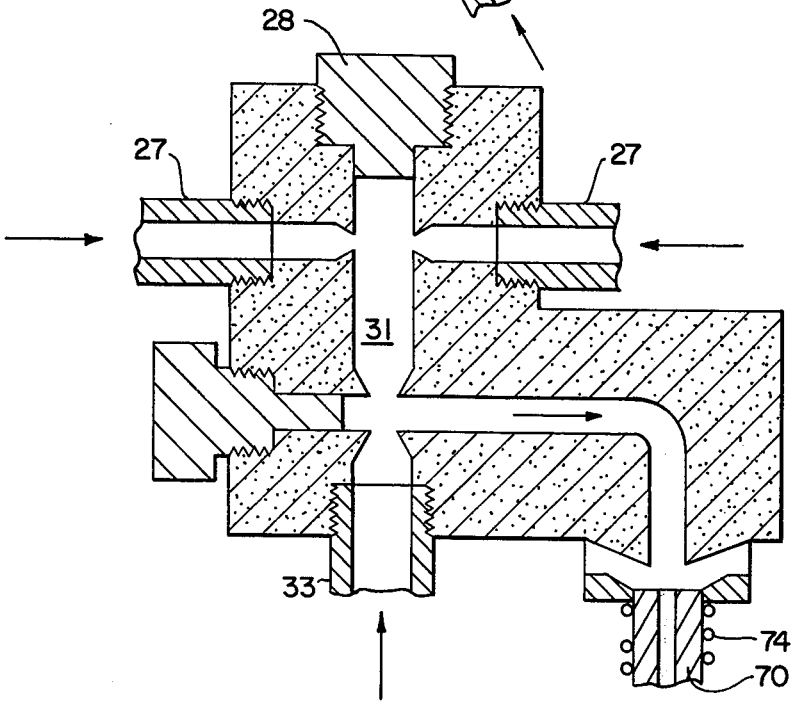
FIG. 10 is a vertical cross-sectional view of an alternative mixing arrangement.

FIG. 10 shows a mixing chamber where only two liquid streams 27 and 29, one initially impinged against each other, followed by an impingement of the mixed liquid 31 with a third stream 33. The liquids are supplied from reservoirs. It should be noted that the number of reservoirs corresponds to the initial number of alloys or metals to be mixed with each other. The resultant liquid composition is directed through channel 35 into mold 70.

Figure 11:
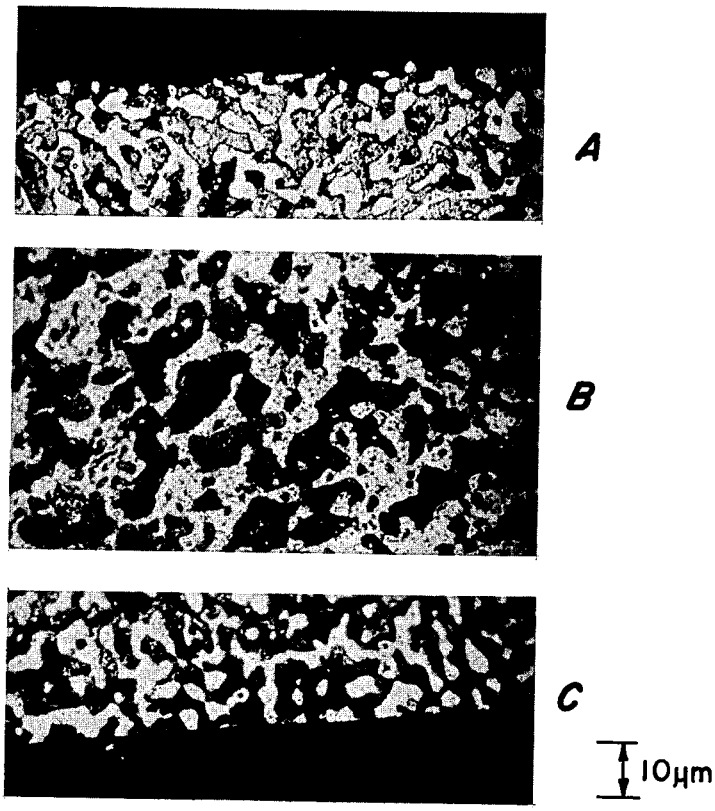
FIG. 11 A–C is a photomicrograph of an alternative form of the compositions produced by this invention.

Referring to FIG. 11, a photomicrograph is shown of an interpenetrating contiguous network structure of a lead-tin alloy specimen of approximately equal volume of tin and lead. The alloy was formed from a tin stream at 280° C. and a lead stream at 370° C. with a mixing pressure of 40 psi in the apparatus of FIG. 3. Section A includes one edge of the specimen. Section B is the mid-portion of the specimen and Section C includes the second edge of the specimen.

Figure 12:
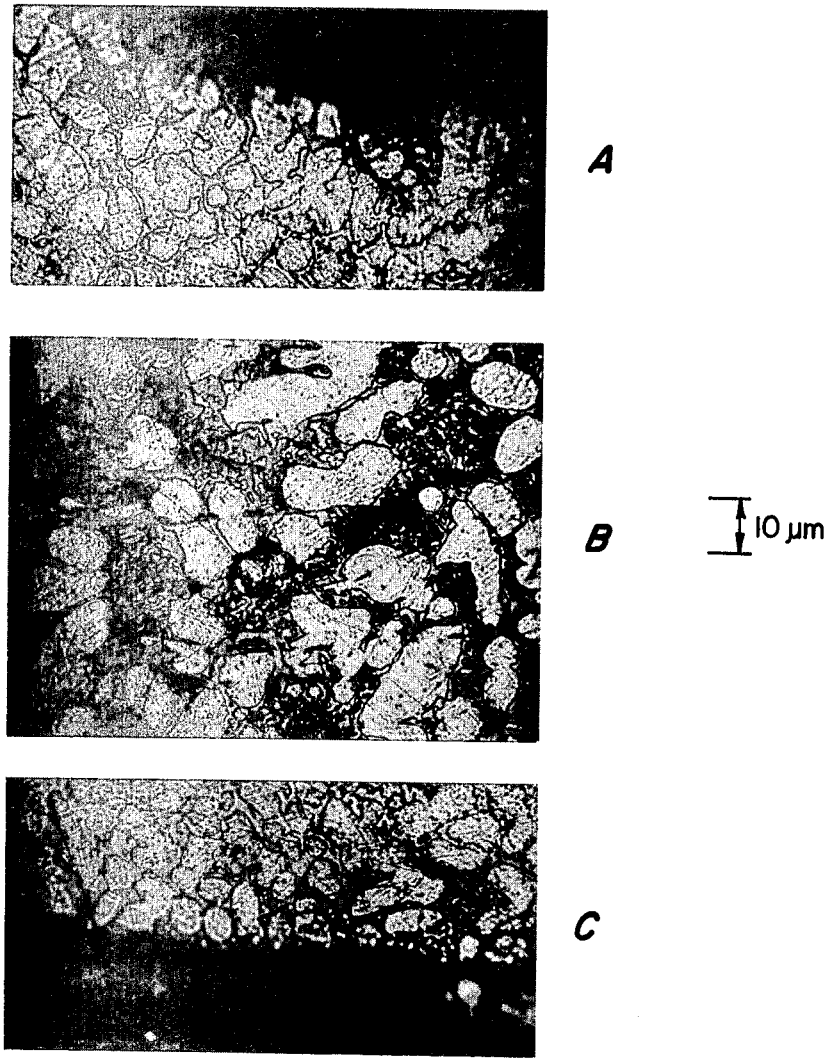
FIG. 12 A–C is a photomicrograph of an aluminum-/aluminum copper alloy mixed at 60 psi.

FIG. 12 is a photomicrograph of an aluminum (light portion), $Al_2Ca$ (dark portion) alloy utilizing 146 g aluminum at 700° C. and 216.9 g of the $Al_2Ca$ alloy at 610° C. The molten streams were mixed at 60 psi utilizing the apparatus of FIG. 3. Sections A and C include one edge of the alloy specimen produced and Section B is the mid-portion of the specimen.

I claim:

1. The process for forming a small grain size composition from at least two liquid streams, each of said streams selected from the group consisting of a polymer, a metal, a metal alloy, a ceramic and a mixture of a ceramic and a metal and/or a metal alloy wherein not more than one of said streams is a polymer, which comprises impinging said liquid streams upon each other to form a turbulent mixture having small eddies, each of said liquid streams having a Reynolds Number based on the nozzle diameter of at least about 50, and quickly freezing said mixture before substantial coalescence of the components of said stream.

2. The process of claim 1 wherein all of said streams are impinged upon each other simultaneously.

3. The process of claim 1 wherein at least three of said liquid streams are impinged upon each other sequentially.

4. The process of claim 1 wherein the components of at least one of said liquid streams freezes to form small solids homogeneously dispersed in the other of said liquid stream upon said impingement.

5. The process of any one of claims 1 through 4 wherein all of said liquid streams comprise a metal or a metal alloy.

6. The process of any one of claims 1 through 4 wherein all of said liquid streams comprise a ceramic.

7. The process of any one of claims 1 through 4 wherein at least one of said liquid streams comprises a metal or metal alloy and at least one of said liquid streams comprises a ceramic composition.

8. A new composition of matter having a small-grain microstructure produced by impinging at least two liquid streams upon one another, each of said streams selected from the group consisting of a polymer/metal, a metal alloy, a ceramic and a metal-ceramic mixture said impingement being such as to form a turbulent mixture having small eddies, each of said liquid streams having a Reynolds number based on the nozzle diameter of at least about 50, and quickly freezing said mixture before substantial coalescence of the components of said streams.

9. The composition of claim 8 wherein the components of at least one of said liquid streams freezes to form small solids homogeneously dispersed in the other of said liquid stream upon said impingement.

10. The composition of any one of claims 8 or 9 wherein all of said liquid streams comprise a metal or a metal alloy.

11. The composition of any one of claims 8 or 9 wherein all of said liquid streams comprise a ceramic.

12. The composition of any one of claims 8 or 9 wherein at least one of said liquid streams comprises a metal or metal alloy and at least one of said liquid streams comprises a ceramic composition.

13. The process for forming a composition having an interpenetrating contiguous network microstructure from at least two liquid streams, each of said streams selected from the group consisting of a polymer, a metal, a metal alloy, a ceramic and a mixture of a ceramic and a metal or a metal alloy which comprises impinging said liquid streams upon each other to form a turbulent mixture having small eddies, each of said liquid streams having a Reynolds number based on nozzle diameter of at least about 50 and freezing said mixture after said eddies have coalesced to form said interpenetrating contiguous network.

14. The process of claim 13 wherein all of said streams are impinged upon each other simultaneously.

15. The process of claim 13 wherein at least three of said liquid streams are impinged upon each other sequentially.

16. The process of claim 13 wherein the components of at least one of said liquid streams freezes to form small solids homogeneously dispersed in the other of said liquid stream upon said impingement.

17. The process of any one of claims 1 through 4 wherein the liquid streams have the same composition and cooling of the mixture of the streams is controlled while agitating the mixture thereby to form a slurry product.

18. The process of any one of claims 1 through 4 wherein the mixture is frozen by continuous casting.

19. The process of claim 13 wherein the mixture is frozen by continuous casting.

* * * * *